US007624520B2

(12) United States Patent
Gordon

(10) Patent No.: US 7,624,520 B2
(45) Date of Patent: Dec. 1, 2009

(54) SIDEWALK GRADER APPARATUS AND METHOD

(76) Inventor: Ronald H. Gordon, P.O. Box 1023, Eatonville, WA (US) 98328

( * ) Notice: Subject to any disclaimer, the term of this patent is extended or adjusted under 35 U.S.C. 154(b) by 406 days.

(21) Appl. No.: 11/533,696

(22) Filed: Sep. 20, 2006

(65) Prior Publication Data

US 2007/0065228 A1 Mar. 22, 2007

Related U.S. Application Data

(63) Continuation of application No. 11/108,928, filed on Apr. 18, 2005, now abandoned.

(51) Int. Cl.
*E02F 5/32* (2006.01)

(52) U.S. Cl. ..... 37/105; 37/407; 37/410; 172/815

(58) Field of Classification Search ..... 37/105, 37/410, 407, 274; 172/4.5, 8, 815
See application file for complete search history.

(56) References Cited

U.S. PATENT DOCUMENTS

| | | | | | |
|---|---|---|---|---|---|
| 2,664,794 | A | | 1/1954 | Evans | |
| 2,825,984 | A | * | 3/1958 | Carter | 37/385 |
| 3,059,355 | A | | 10/1962 | Patterson et al. | |
| 3,346,976 | A | * | 10/1967 | Curlett et al. | 172/4.5 |
| 3,566,759 | A | | 3/1971 | Gurries | |
| 3,651,588 | A | | 3/1972 | Hanson | |
| 3,736,987 | A | * | 6/1973 | Easterling | 172/4.5 |
| 3,914,064 | A | | 10/1975 | Gurries | |
| 4,113,402 | A | | 9/1978 | Schillinger | |
| 4,142,815 | A | | 3/1979 | Mitchell | |
| 4,516,639 | A | | 5/1985 | Hammarlund | |
| 4,789,266 | A | | 12/1988 | Clarke, Jr. et al. | |
| 5,377,766 | A | * | 1/1995 | Klinger | 172/782 |
| 5,470,175 | A | | 11/1995 | Jensen et al. | |
| 5,662,431 | A | | 9/1997 | Colvard | |
| 5,701,693 | A | * | 12/1997 | Brocious et al. | 37/381 |
| 6,109,825 | A | | 8/2000 | Yon | |
| 6,168,348 | B1 | | 1/2001 | Meyer et al. | |
| 6,322,287 | B1 | | 11/2001 | Yelton | |
| 6,543,962 | B2 | | 4/2003 | Wells | |
| 2002/0134559 | A1 | | 9/2002 | Newman | |
| 2003/0132014 | A1 | | 7/2003 | Marshall | |
| 2006/0230646 | A1 | * | 10/2006 | Schmidt et al. | 37/381 |

(Continued)

*Primary Examiner*—Gary S Hartmann
(74) *Attorney, Agent, or Firm*—Davis Wright Tremaine LLP; George C. Rondeau, Jr.

(57) ABSTRACT

A sidewalk grader provided for grading a sidewalk base disposed along a curb of an existing road structure. The sidewalk grader comprises a tracking assembly fixable to a vertically adjustable backfill blade of a compact excavator positioned to move forward over an existing road structure to advance the sidewalk grader. The tracking assembly comprises a vertically adjustable tracking means disposed for engagement with the top surface of the curb, to provide a reference point. A grading assembly is mounted to the tracking assembly. The grading assembly comprises a frame, and a grading blade rotatingly mounted to the frame to permit adjustment of slope of the blade. An adjustable link connects the grading blade to the frame to adjustable fix their relative position. The tracking means is vertically adjustable to enable the same to engage with the surface of a curb for reference to enable precise adjustment, control, and positioning of the grading assembly, and for maintaining the desired position of the sidewalk grader in relation to the curb as the sidewalk grader advances along the existing road structure.

7 Claims, 12 Drawing Sheets

U.S. PATENT DOCUMENTS

2007/0033840 A1* 2/2007 Schmidt ..... 37/383
2007/0065228 A1* 3/2007 Gordon ..... 404/96
2007/0183847 A1 8/2007 Gordon et al.

* cited by examiner

FIG. 11
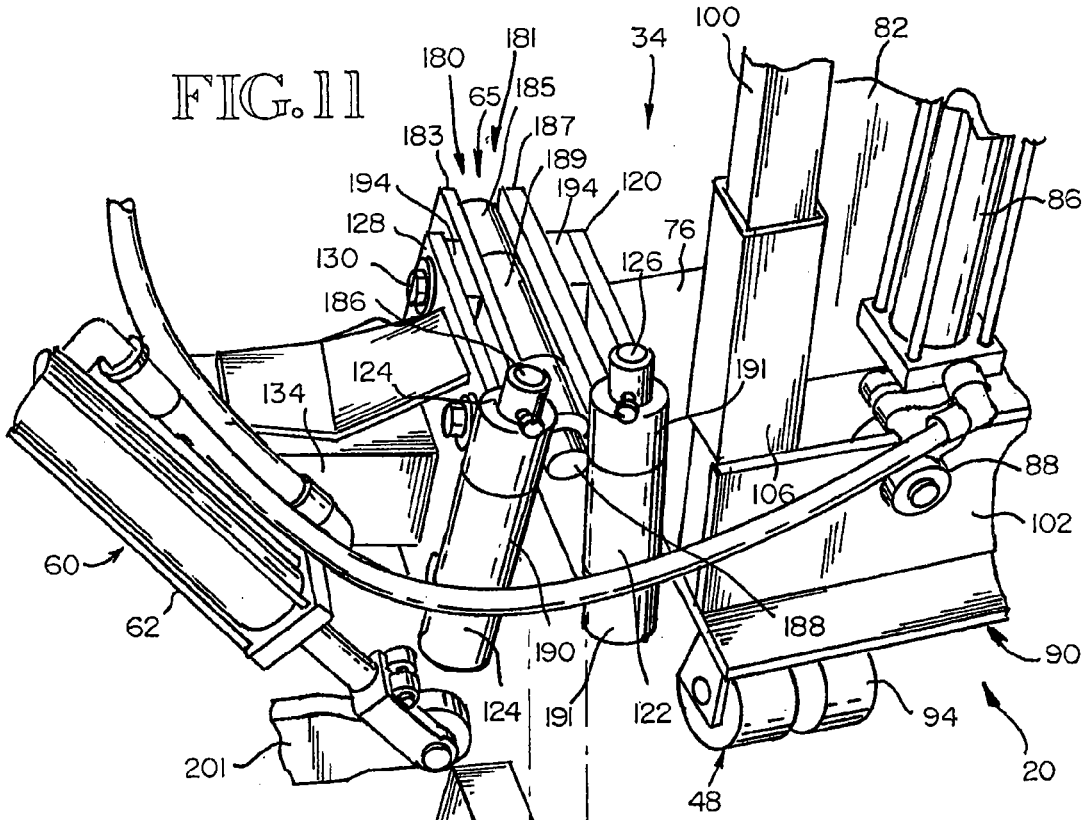
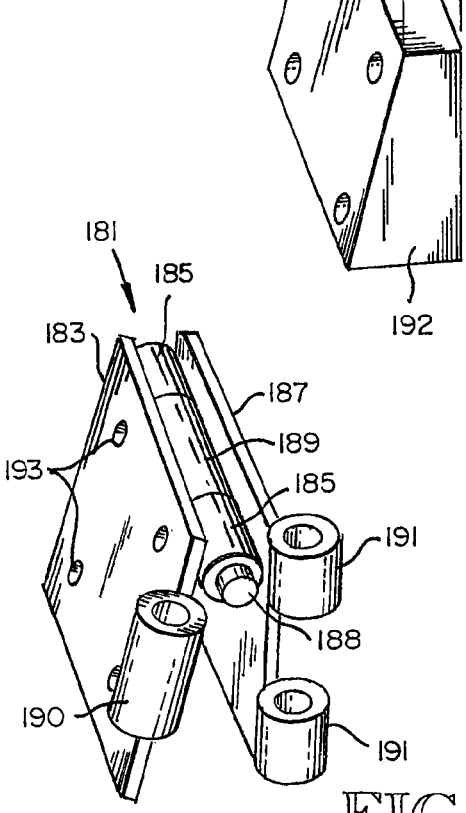
FIG. 11A
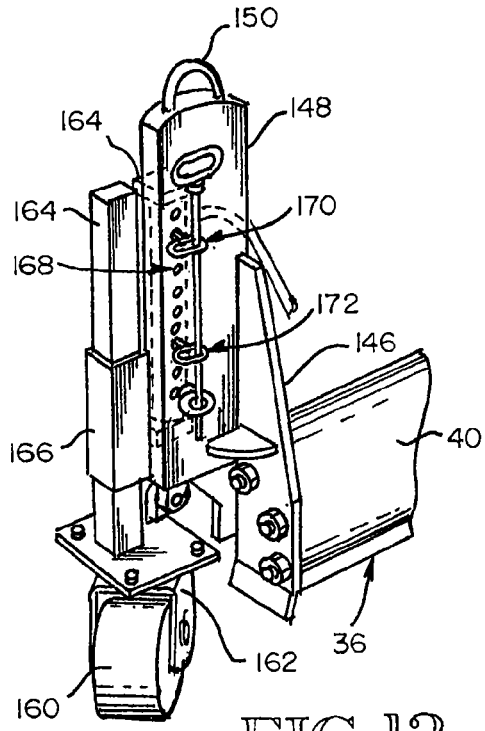
FIG. 12

SIDEWALK GRADER APPARATUS AND METHOD

CROSS REFERENCE TO RELATED APPLICATION(S)

This application is a continuation application of U.S. Ser. No. 11/108,928 filed Apr. 18, 2005.

BACKGROUND OF THE INVENTION

This invention relates generally to earth moving and excavation equipment, and more particularly to equipment provided to finish grade sidewalk base material including crushed rock, in preparation for a concrete or asphalt sidewalk overlay.

Construction equipment provided to grade a road base or sidewalk base are well known, and have been employed in such work for quite some time. Typically, a sidewalk base, for a specified sidewalk site is prepared by grading the same to a specific elevation. This is sometimes followed by base material being brought in by truck or loader equipment which requires additional grading.

For this purpose, blade type grading equipment is usually employed along with a crew of construction workers using rakes, shovels and the like to add or take away material as needed by the operator of the finish grader. Accordingly, this process consumes a large amount of manpower, and is slow thereby tying-up resources that could be used else where on the construction site.

For example, one early sidewalk grader is disclosed in U.S. Pat. No. 2,664,794 issued in 1954 showing a hopper-like storage bin for spreading base material over a sidewalk area, as the storage bin is pulled or dragged along the sidewalk base area. This design requires constant loading of the hopper, and would also require a smooth ground in front of the machinery which is dragged.

Another early design is U.S. Pat. No. 2,825,984 issued in 1958 which discloses a sidewalk fine grader for grading the earth between steel edge forms laid down on grade to provide side-forms for pouring concrete sidewalks. Like the '984 patent, this device travels directly over the sidewalk base and also requires a pair of spaced base rails installed to guide the machine.

In 1962 U.S. Pat. No. 3,059,355 issued disclosing a curb and sidewalk grading device that is pulled by a tractor or the like between form-rails similar to the '954 device. In addition, this invention uses an internal rotating auger-like member disposed horizontally to grade the base material. This design would be difficult to operate with base material that is larger than fine granular material.

A later design is U.S. Pat. No. 3,566,759 issued in 1971 showing a mounting arrangement for sidewalk building equipment where a motorized, wheeled vehicle employs sensors to sense reference points to follow a predetermined path. This design is complicated, and requires pre-installation of reference points.

Various other later designs, include U.S. Pat. No. 3,651,588 issued in 1972, U.S. Pat. No. 3,914,064 issued in 1975, and U.S. Pat. No. 4,113,402 issued in 1978. These designs are based on complicated machinery that is built integrally with the grading apparatus thereby increasing its initial cost.

More recent inventions include U.S. Pat. No. 6,109,825 issued in 2000, U.S. Pat. No. 6,168,348 issued in 2001, and U.S. Pat. No. 6,322,287 issued in 2001 which show machines designed for the placement of material, wherein each of the same vary in complexity and consistency of intended results.

In particular, the '287 reference relies on the upper edge of a concrete form to provide a reference point to grade the sidewalk base as the machine moves over the same.

Importantly, none of the designs noted above are intended to employ a point of reference provided by existing, permanent portions of road structures to finish grade a sidewalk base. Further, none of the above designs are intended to be used with common construction equipment that is not required to be positioned over the sidewalk base while advancing forward to grade the same.

Accordingly a need remains for a simple design to precisely grade and prepare the base of a sidewalk with reference to existing, permanent portions of an existing road structure, while minimizing the manpower required, and while quickly advancing the sidewalk grading process, minimizing the number of passes over the sidewalk base to complete the grading process.

SUMMARY OF THE INVENTION

One object of the invention is to precisely grade and prepare the base of a sidewalk according to its exact planned, engineered and reserved location while minimizing the number of passes over the sidewalk base.

A second object is to decrease the amount of time a contractor spends to prepare the base of a sidewalk according to its engineered reserved location in relation to the adjacent road structure.

Another object is to reduce the number of man-hours required to prepare the base of a sidewalk according to specification.

Yet another object is to increase the accuracy and quality of the base of a sidewalk to meet the specifications according to its exact planned and engineered location.

A further object is to reduce the amount of concrete required to form a finished sidewalk.

Still another object is to reduce the time that a subcontractor has to be on a job site.

The invention is a sidewalk grader provided for grading sidewalk base material, including crushed rock, to a predetermined specified grade and elevation to form the base of a designed sidewalk. Typically, the sidewalk grader accommodates grading activity for sidewalks that extend adjacent to and along an existing road structure of the type that incorporates a curb as a border.

In its construction, the sidewalk grader comprises a tracking assembly adapted for fixable engagement with a vertically movable accessory extending from a piece of construction excavation equipment. Commonly, a vertically adjustable backfill blade extending from a compact excavator is the ideal accessory for this purpose. The construction equipment is generally positioned to move forward over an existing road structure to advance the sidewalk grader in a direction along the existing road structure, substantially parallel thereto. Importantly, the excavation equipment so provided is disposed and operated over an existing road structure thereby minimizing the impact it has on the sidewalk base. Accordingly, the tracking assembly is configured to extend from the vertically movable accessory, or blade, in a transverse direction to the course of advancement, transversely across the road structure and the curb thereof.

Additionally, the tracking assembly further comprises a vertically adjustable tracking means disposed for engagement with the top surface of the curb portion of the road structure. With this configuration, the top surface of the curb provides a point of reference for operation of the sidewalk grader.

Importantly, a grading assembly is mounted and fixed to the tracking assembly so that the grading assembly extends outward, beyond the curb portion, positioned over the location of the area reserved for the designed sidewalk and base thereof. More specifically, the grading assembly comprises a frame, and a grading blade rotatingly mounted to the frame to permit adjustment of slope of the blade according to the specified sidewalk design grade. In order to lock the rotation of the grading blade, at a predetermined position, in relation to the frame, a means for fixing the blade rotation is provided. One common way to provide such fixing means is to provide an adjustable link with one end connected to the frame, and the opposing end connected to the grading blade.

As noted above, the tracking means is vertically adjustable. This feature is provided to enable the tracking means to engage with the top surface of a curb, that is used to provide a point of reference, for precise adjustment, control, and positioning of the grading assembly, and for maintaining the desired position of the sidewalk grader in relation to the curb as the sidewalk grader advances along the existing road structure. Because the top surface of the curb is usually rough concrete, the preferred tracking means is constructed for rolling engagement along the top surface of the curb. However, other arrangements would be employed, for example a flat rigid shoe could be formed to slide over the curb.

The foregoing and other objects, features, and advantages of this invention will become more readily apparent from the following detailed description of a preferred embodiment which proceeds with reference to the accompanying drawings, wherein the preferred embodiment of the invention is shown and described, simply by way of illustration of the best mode contemplated of carrying out the invention. As will be realized, the invention is capable of other and different embodiments, and its several details are capable of modifications in various obvious respects, all without departing from the invention. Accordingly, the drawings and description are to be regarded as illustrative in nature, and not as restrictive.

BRIEF DESCRIPTION OF THE DRAWING(S)

Figure 10:
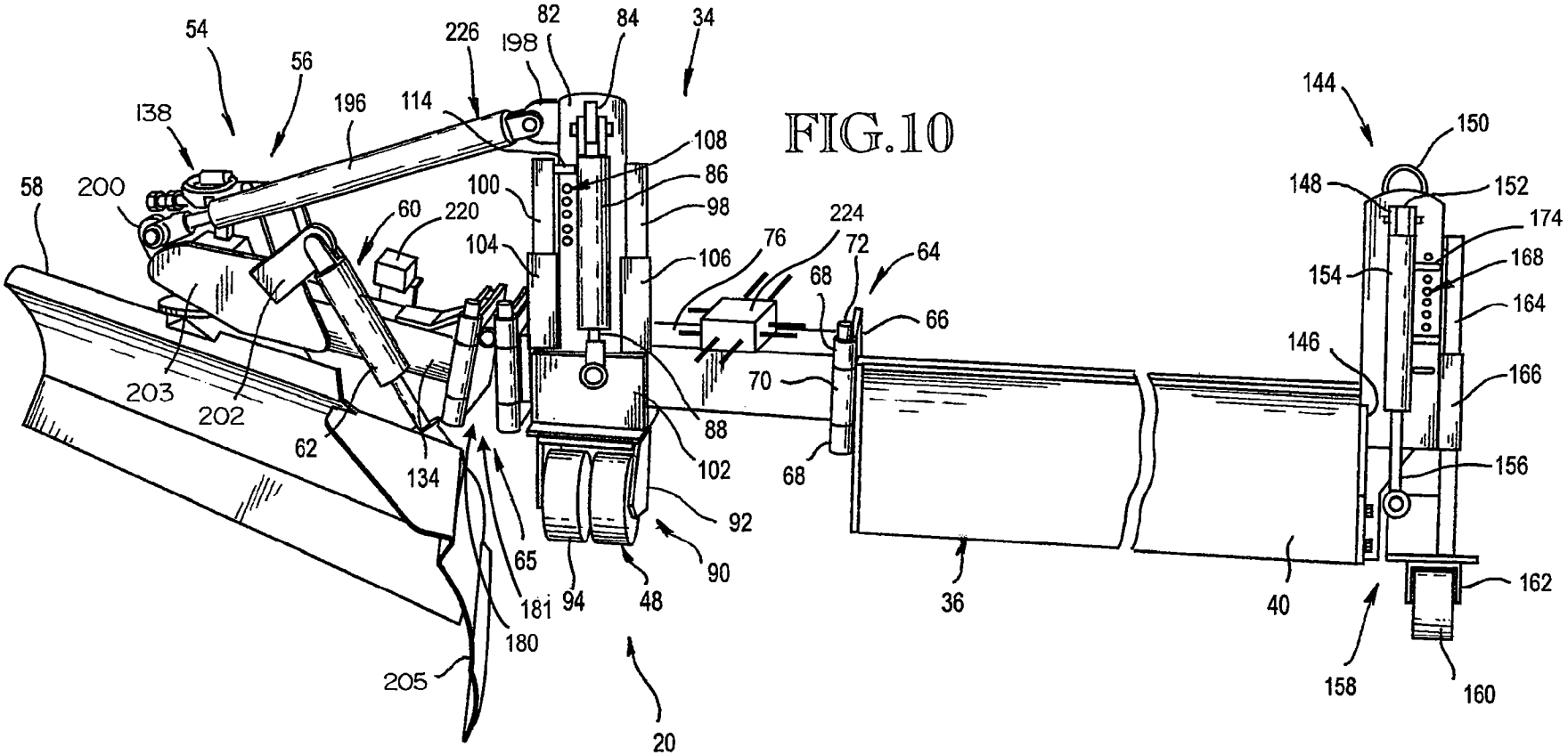

FIG. 10 is a front elevation view of a sidewalk grader fixed to one end of a backfill blade of a compact excavator, and a hydraulically operated, vertically adjustable backfill blade stabilizer fixed to the opposing end of the backfill blade, the sidewalk grader having a dual-axis pivot joint connecting the grading assembly to the tracking assembly, and the backfill blade stabilizer having a wheel for rolling engagement with the existing road structure.

FIG. 11 is a partial perspective view illustrating a dual-axis pivot joint defined by a portion of the tracking assembly, wherein the dual-axis pivot joint permits the grading assembly to pivot upward and downward to control grading blade slope, as well as pivot sideways to fold the grading assembly from a first fixed unfolded position extending outward from the tracking assembly, to a second folded position adjacent the blade of the excavator, wherein a optional wedge is also illustrated to represent an alternate embodiment where the upward pivot capability of the joint is fixed by the wedge so that the slope control link is not required and can therefore be eliminated.

FIG. 11A is a perspective view illustrating a hinge insert employed to fit into a pivot joint to enable the same to pivot up and down about a substantially horizontal axis.

FIG. 12 is a partial rear perspective view illustrating a hydraulically operated, vertically adjustable backfill blade stabilizer having a wheel for rolling engagement with the existing road.

Figure 13:
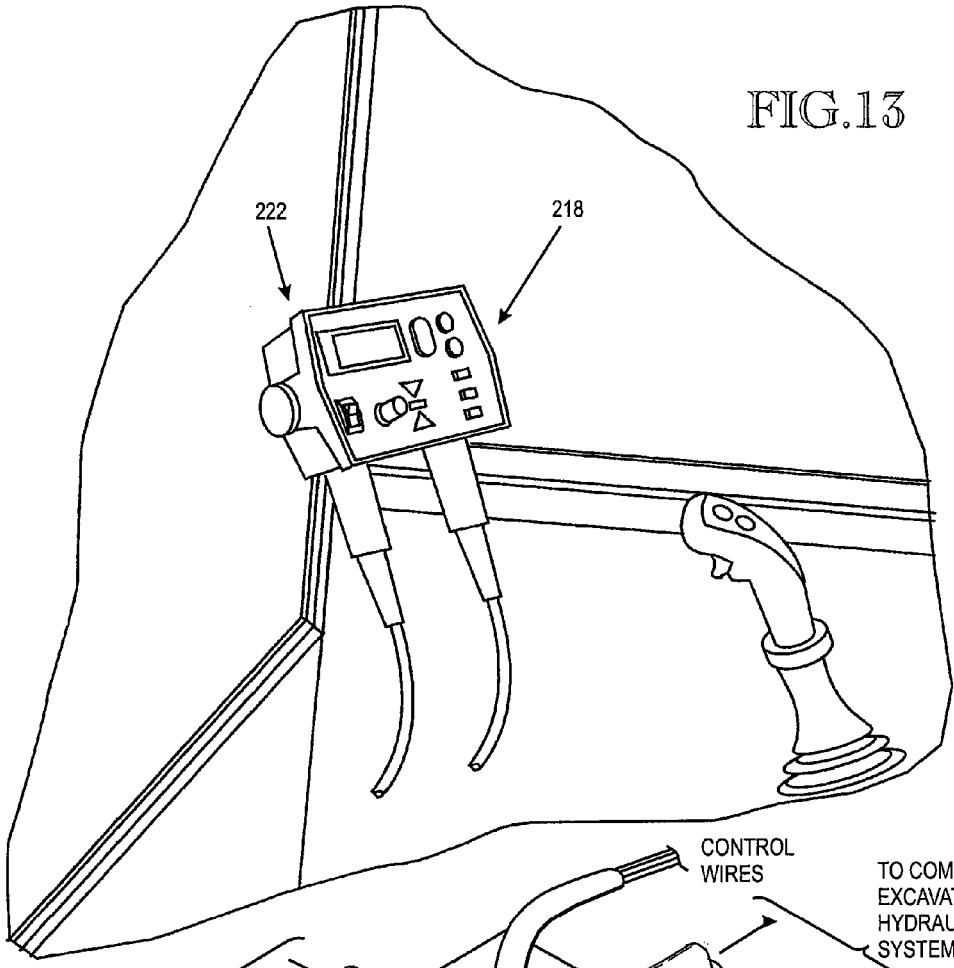

FIG. 13 is a perspective view illustrating the inside of a cab of a compact excavator having a Topcon system five 9256 control box for controlling the hydraulically actuated slope control link for controlling the slope of the grading blade, and a hand-controlled "joy-stick" with thumb buttons for electronically controlling the up & down motion of the backfill blade, and for controlling the up & down motion of the backfill blade stabilizer in combination with the up and down motion of the tracking means, i.e., tracking roller.

Figure 14:
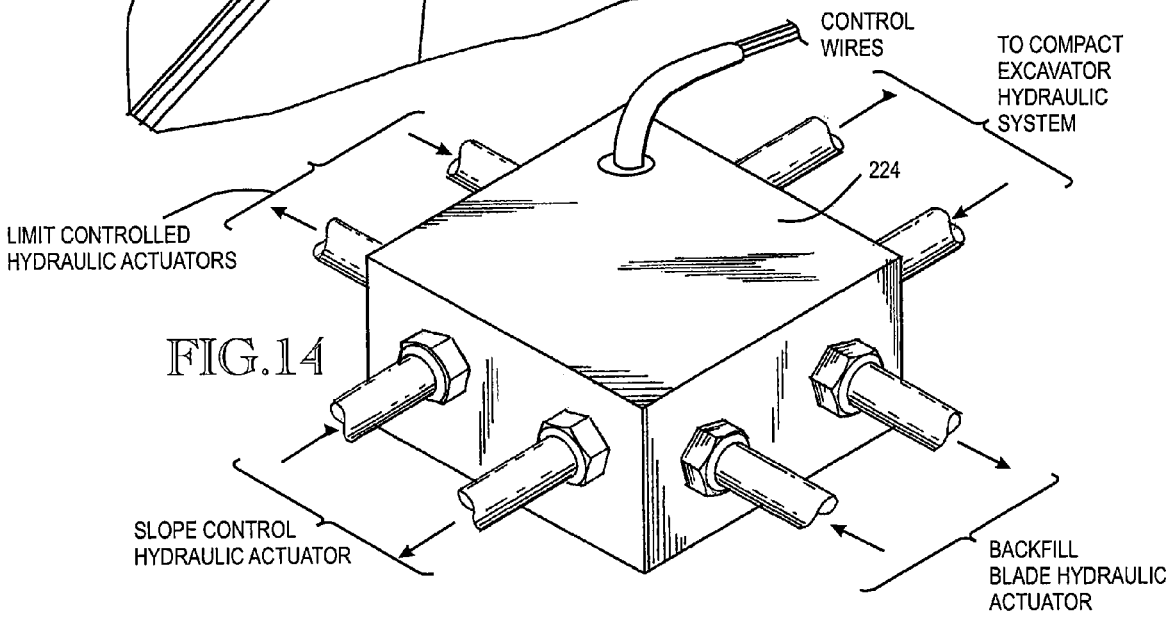

FIG. 14 is a perspective view of an electrically operated hydraulic valve stack having two primary hydraulic control lines that are redirected from the original-stock compact excavator backfill blade hydraulic circuit, which is now redirected to hydraulically supply three hydraulic circuits including:

(1) a hydraulically actuated slope control link in electronic communication with the Topcon positioning system for control of the slope control link to maintain a specified slope to produce the specified sidewalk base grade;

(2) a hydraulically actuated circuit having three limit controlled hydraulic actuators for moving the sidewalk grader from a first sidewalk grading position, to a second driveway grading position, wherein any or all of the actuators can be disabled and removed; and (3) a backfill blade hydraulically actuated circuit defined by the original hydraulic actuators of the backfill blade.

Figure 15:
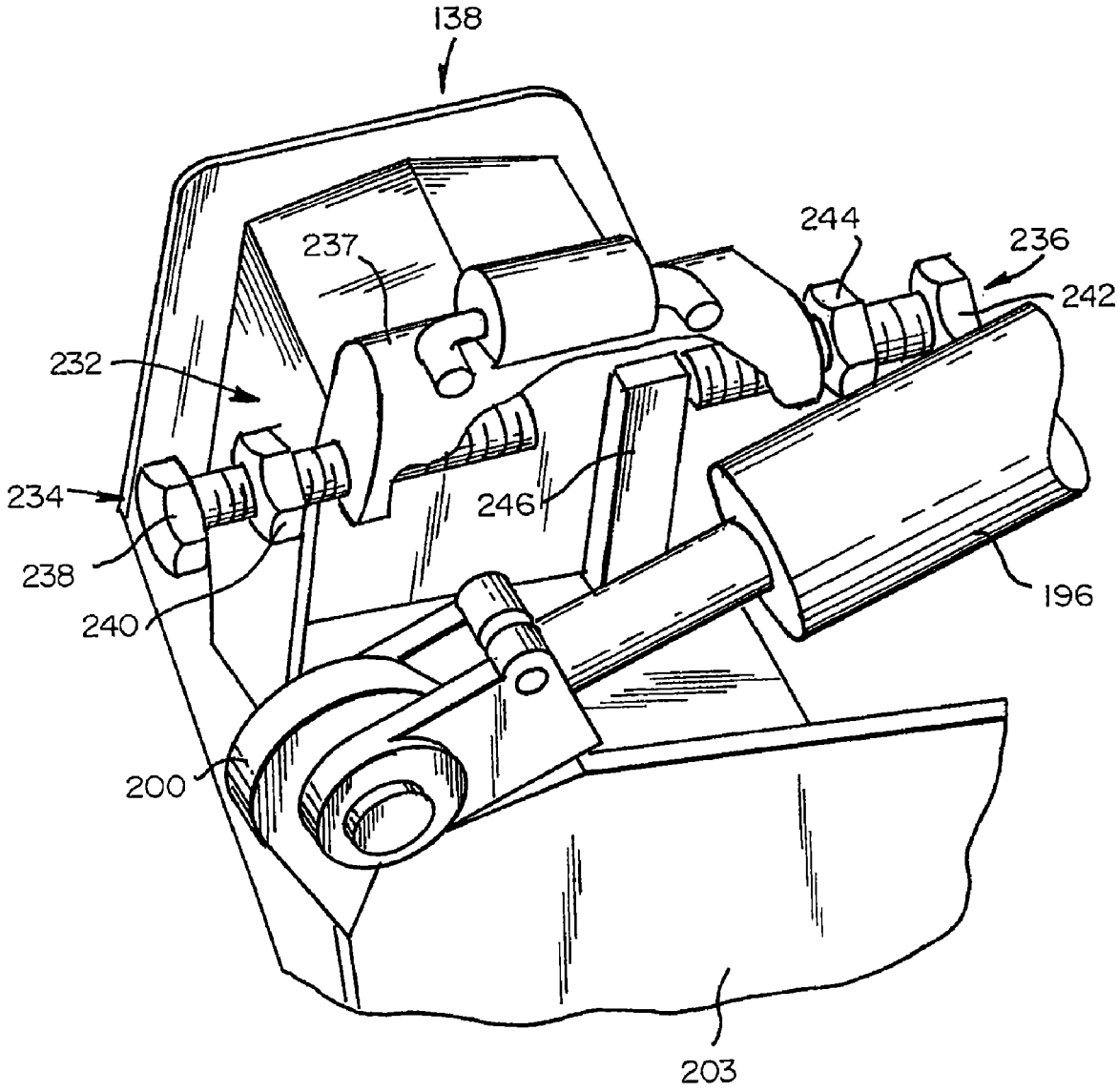

FIG. 15 is a partial perspective view looking down at the frame of a grading assembly and the adjustable limit control stop thereof, the frame having a limit lug being disposed between a first limit stop bolt and a second limit stop bolt, wherein the limit stop bolts define a range that the grading blade can rotate in relation to the frame as the hydraulically actuated adjustable blade link is operated between the first sidewalk grading position and the second driveway grading position.

Figure 16:
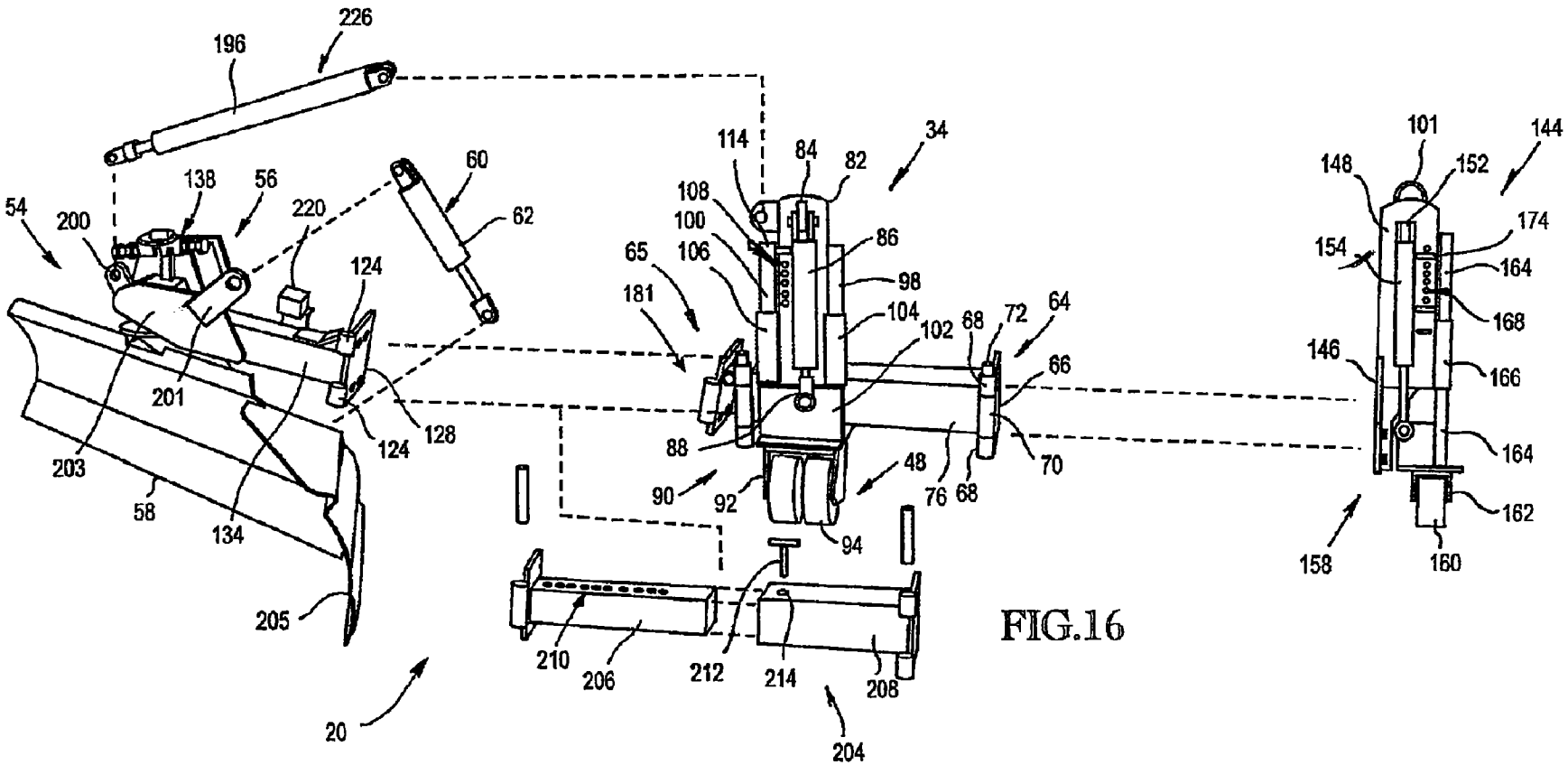

FIG. 16 is an exploded elevational view illustrating the primary components of a sidewalk grader including an optional extension assembly provided to extend the grading assembly to accommodate the situation where a specified sidewalk base is spaced-apart from the curb of a road structure.

DETAILED DESCRIPTION OF PREFERRED EMBODIMENT

Referring to FIGS. 1 through 16 of the drawings, numeral 20 generally designates a sidewalk grader. The sidewalk grader 20 is provided for preparing and grading sidewalk base material 22, which sometimes includes crushed rock 24, to a predetermined specified grade and elevation to form the base 26 of a designed sidewalk (not illustrated). Typically, the sidewalk grader 20 accommodates grading activity for sidewalks that extend adjacent to and along an existing road structure 30 of the type that incorporates a curb 32 as a border.

More specifically, the sidewalk grader 20 comprises a tracking assembly 34 adapted for fixable engagement with a vertically movable accessory 36 extending from a piece of construction excavation equipment 38. Commonly, a vertically adjustable backfill blade 40 extending from a compact excavator 42 is the ideal accessory 36 for this purpose. In addition, when a compact excavator 42 is used, the bucket 43 thereof, can be very useful to either remove or add additional sidewalk base material 22 depending on the condition of the site reserved for the sidewalk. In addition, as the sidewalk grader 20 advances along the road structure 30, the bucket 43 can be used to break-up native hard-pan type soil, and to remove large rocks and the like. Accordingly, the use of a bucket 43, on a compact excavator 42 can greatly increase the productivity of the grading process.

The construction equipment 38 is generally positioned to move forward over an existing road structure 30 to advance the sidewalk grader 20 in a direction along the existing road structure 30, substantially parallel thereto. This forward movement is indicated by arrow 46. Importantly, the excavation equipment 38 so provided is disposed and operated over an existing road structure 30 thereby minimizing the impact it has on the base 26. Accordingly, the tracking assembly 34 is configured to extend from the vertically movable accessory 36, or similarly, a backfill blade 40, in a transverse direction to the course of advancement (indicated by an arrow 46), transversely across the road structure 30 and the curb 32 thereof.

In addition, the tracking assembly 34 further comprises a vertically adjustable tracking means 48 disposed for engagement with the top surface of the curb 32 portion of the road structure 30. With this configuration, the top surface 50 of the curb 32 provides a point of reference for operation of the sidewalk grader 20.

Importantly, a grading assembly 54 is mounted and fixed to the tracking assembly 34 so that the grading assembly 54 extends outward, beyond the curb 32, positioned over the location of the area reserved for the designed sidewalk and base 26 thereof. More specifically, the grading assembly 54 comprises a frame 56, and a grading blade 58 rotatingly mounted to the frame 56 to permit adjustment of slope of the grading blade 58 according to the specified sidewalk design grade. In order to lock or fix the rotation of the grading blade 58 in relation to the frame 56, according to a predetermined grade, a means 60 for fixing the blade rotation is provided. One common way to provide such fixing means 60 is to provide an adjustable blade link 62 with one end connected to the frame 56, and the opposing end connected to the grading blade 58. It should be understood that there are many existing mechanisms that could be employed as an adjustable blade link 62. For example, a hydraulic cylinder or actuator could be used, and allow the operator to control the same from a remote location like the inside of a cab. Another good example would be a ratchet-type turnbuckle that is set by hand, and maintains the setting until another hand adjustment is completed.

As noted above, the tracking means 48 is vertically adjustable. This feature is provided to enable the tracking means 48 to engage with the top surface 50 of a curb 32 to provide a relative reference, or point of reference, for precise vertical and horizontal adjustment of the sidewalk grader 20, to position the grading assembly 54, and for maintaining the grading assembly in the desired position in relation to the curb as the sidewalk grader 20 advances along the existing road structure 30 as indicated by arrow 46.

Because the top surface 50 of the curb 32 is usually rough concrete, the preferred tracking means 48 is constructed for rolling engagement along the top surface 50 of the curb 32. However, other arrangements would be employed, for example a flat rigid shoe (not illustrated) could be adapted to slide over the curb. Additionally, a brush 63 is attached to the tracking assembly 34, in front of the tracking means 48 to remove any rocks or debris on the curb 32 that might interfere with the tracking means 48

Figure 2A:
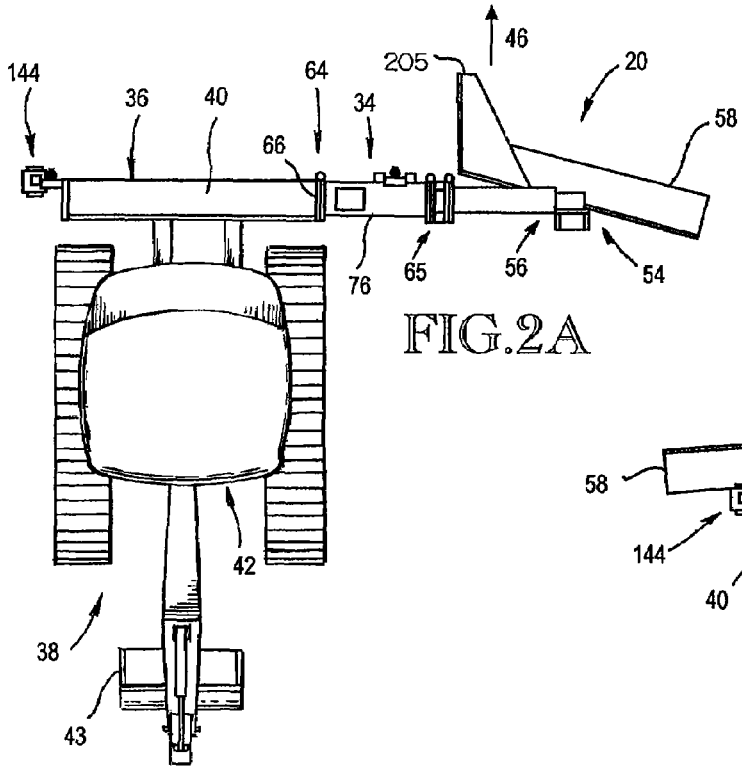
FIGS. 2A through FIG. 2C are a sequence of overhead plan views of a sidewalk grader fixed to the backfill blade of a compact excavator, the sequence illustrating the folding motion of a sidewalk grader moving from a unfolded position (FIG. 2A) to an folded position (FIG. 2C).
Figure 2C:
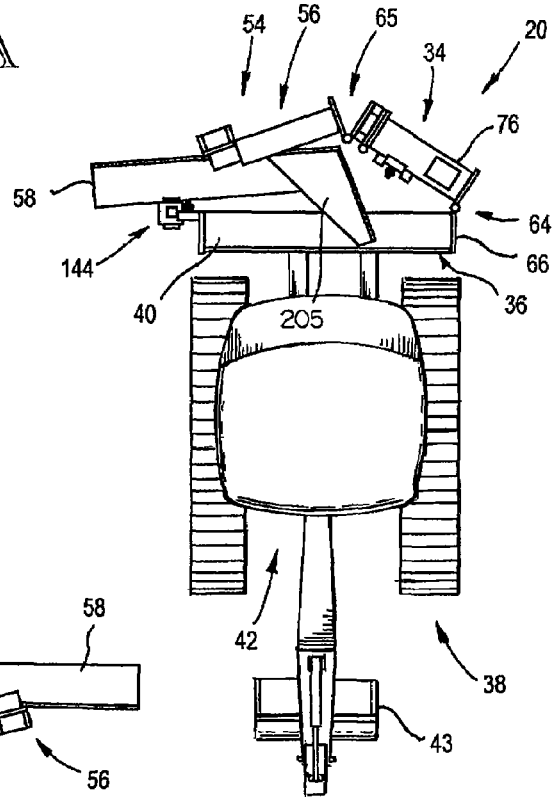
Figure 2B:
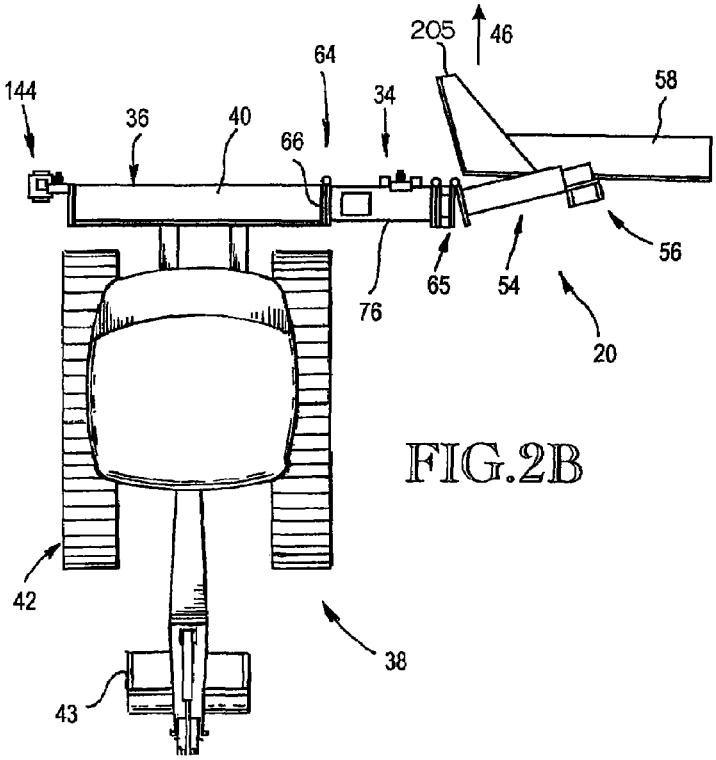
Figure 3:
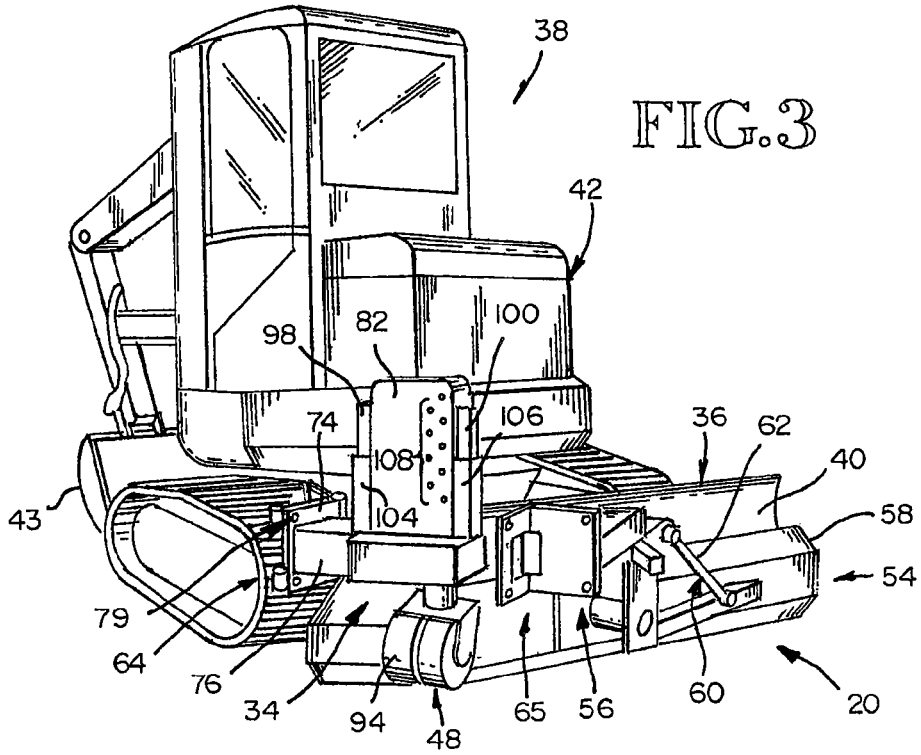
FIG. 3 is a perspective view of a sidewalk grader in a folded position, adjacent to, and in front of the backfill blade of a compact excavator.
Figure 4:
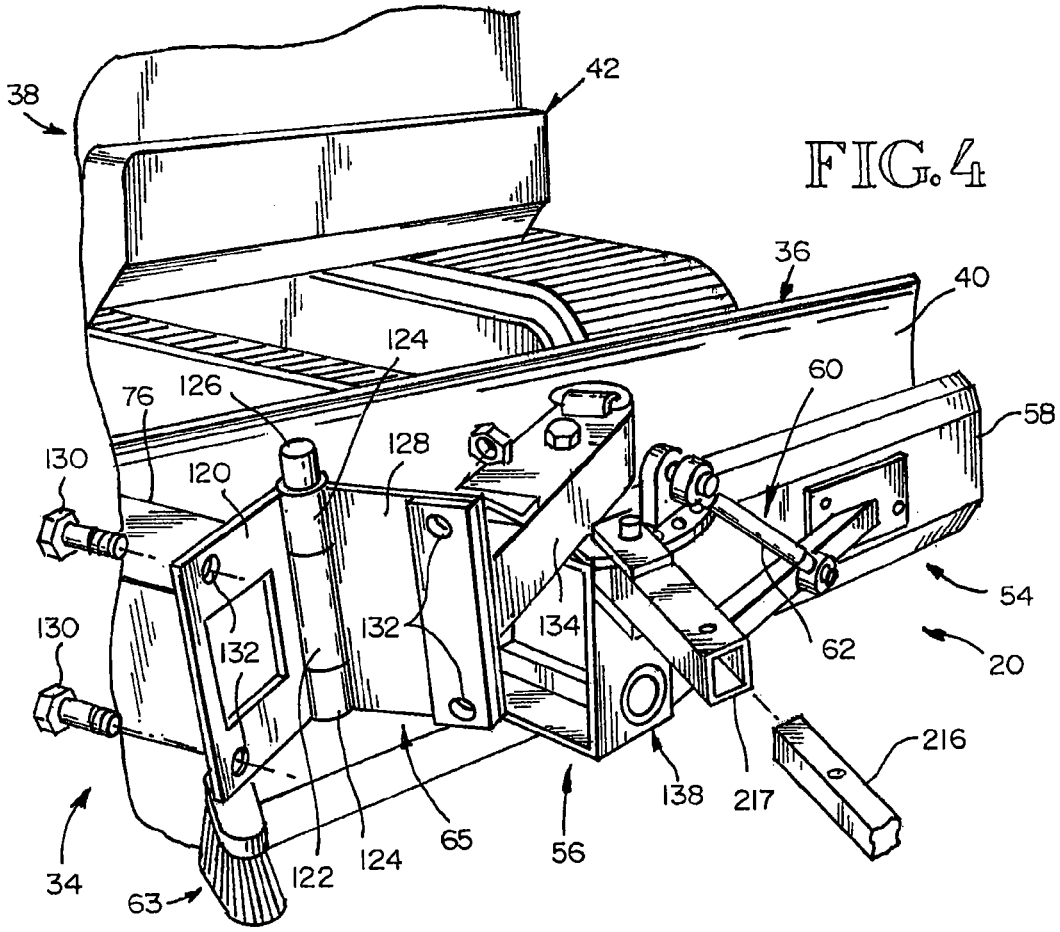
FIG. 4 is a partial perspective view of a sidewalk grader in a folded position adjacent to, and in front of the backfill blade of an excavator, wherein the grading assembly includes a brace partially exploded to illustrate the attachment thereof to the frame of the grading assembly.

Considering now in more detail the structure of sidewalk grader 20, in a simplified embodiment of the sidewalk grader 20, the tracking assembly 34 comprises a pivot joint 64, disposed adjacent the backfill blade 40 to enable the sidewalk grader 20 to fold from a first unfolded position as illustrated in FIGS. 5 through 8, to a folded position as illustrated in FIGS. 3 and 4. This folding action is also illustrated in FIG. 2A through FIG. 2C which show a sequence of the sidewalk grader 20 folding from an unfolded position in 2A, to a fully folded position in 2C, in front of the backfill blade 40 of a compact excavator 42. Also illustrated in this sequence is an additional pivot joint 65 provided to form an additional folding point to fold the sidewalk grader 20 for storage and transportation. As will be discussed more fully below, pivot joint 65 can provide an additional pivot axis for up and down movement of the grading assembly 54 to provide greater flexibility thereof.

Figure 6:
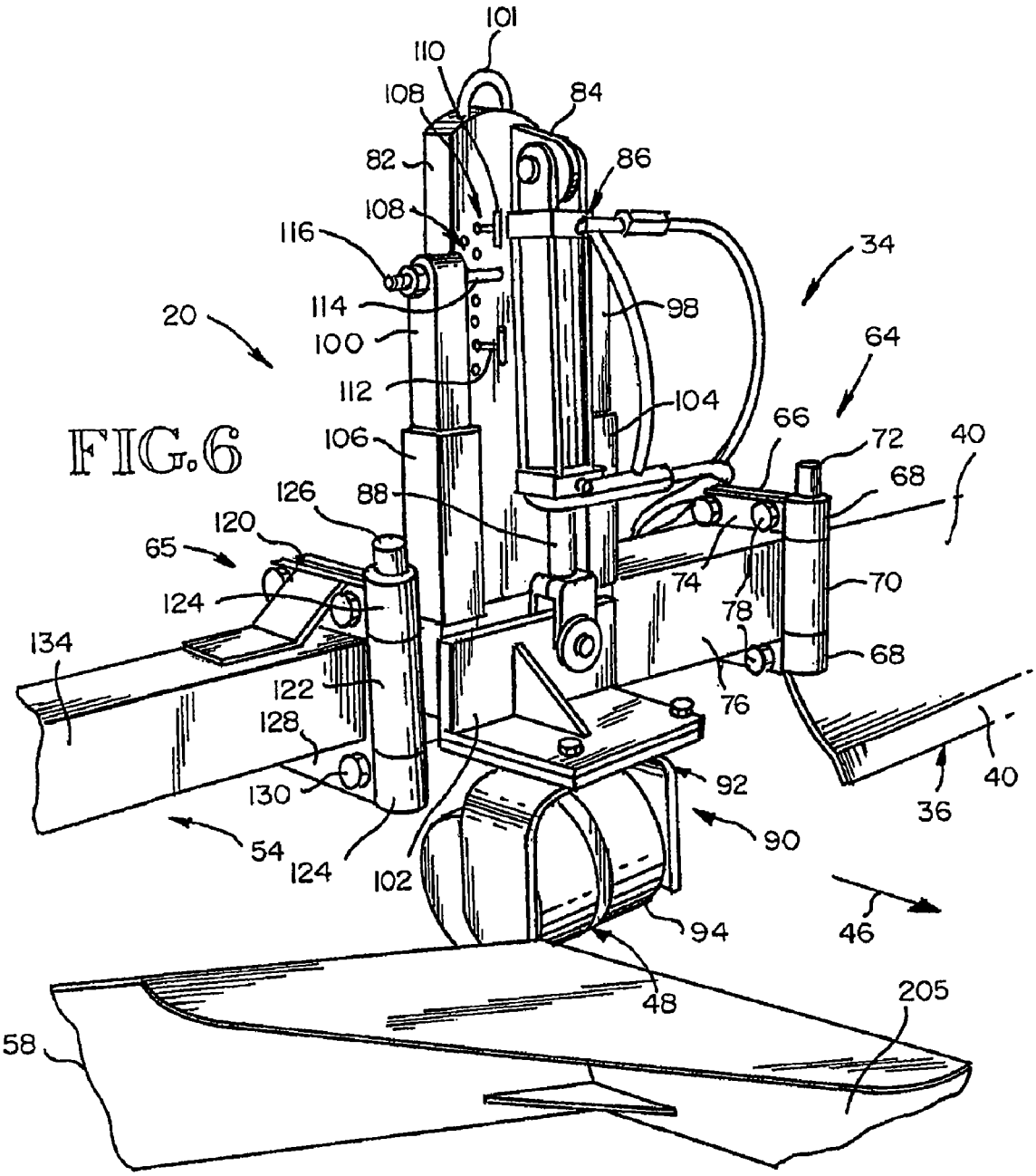
FIG. 6 is a partial front perspective view of the tracking assembly in the unfolded position fixed to the backfill blade of a compact excavator.

The pivot joint 64 includes a hinge bracket plate 66 that is welded by weld 67 to the end of backfill blade 40 (see FIG. 6). It should be noted, however that the hinge bracket plate 66 could be welded on to any vertically adjustable accessory of excavation construction equipment such as a skid-steer loader (not illustrated) with similar results.

In this way, stationary hinge sleeve 70 can be welded to the hinge bracket plate 66 as illustrated in FIG. 6. This arrangement facilitates a pivotal connection with spaced-apart rotating upper and lower hinge sleeves 68 disposed to receive stationary hinge sleeve 70 therebetween, in axial alignment to allow a pivot pin 72 to be placed through all three aligned sleeves.

Figure 7:
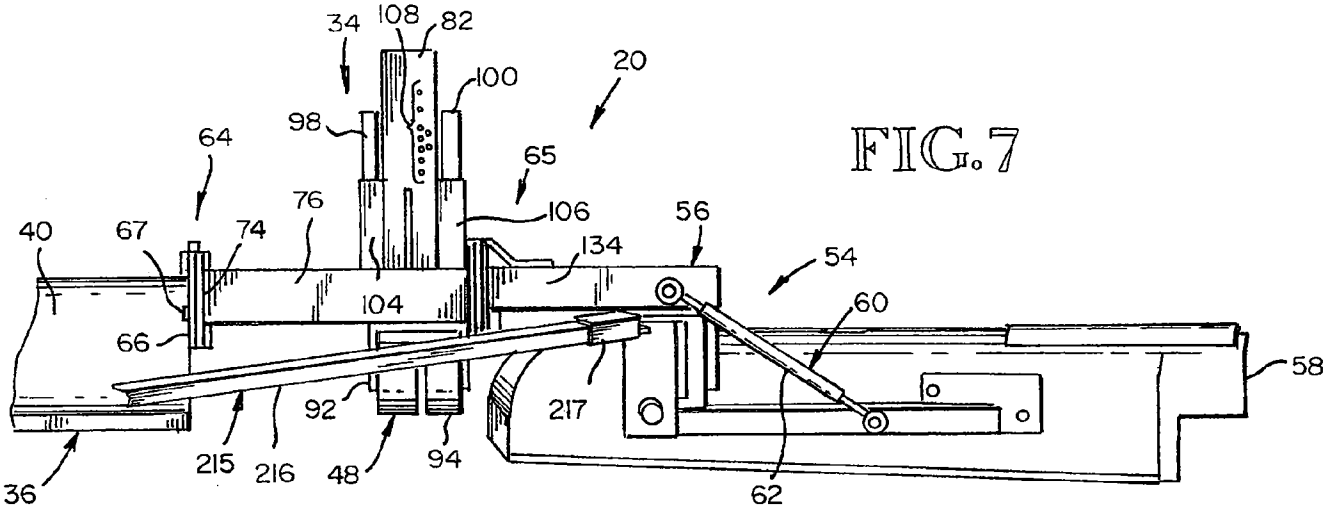
FIG. 7 is a partial rear elevation view of a sidewalk grader fixed to a backfill blade of a compact excavator, wherein the frame of the grading assembly is braced.
Figure 8:
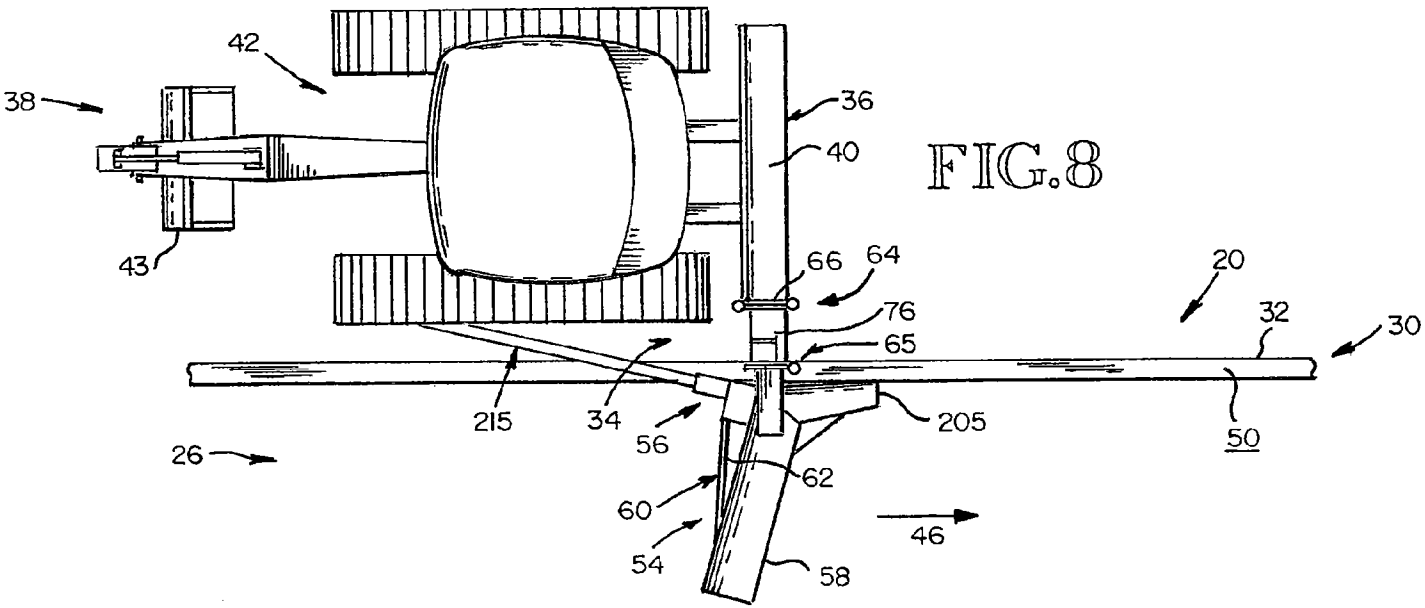
FIG. 8 is a plan view illustrating a sidewalk grader fixed to a backfill blade of a compact excavator, wherein the sidewalk grader is in the unfolded position, with portions thereof extending over a curb, and where the frame of the grading assembly is braced to the structure of the compact excavator.

As illustrated in FIG. 4, the spaced-apart rotating upper and lower hinge sleeves 68 are welded to a header flange plate 74 thereby permitting the header flange plate 74 to pivot. In order to firmly hold the header flange plate 74 in place when the sidewalk grader 20 is in the unfolded position, a plurality of bolts 78 are placed through aligned holes 79 (FIG. 3) provided in the hinge bracket plate 66 and header flange plate 74 when the two plates are butted together as illustrated in FIGS. 6 and 7. Likewise, a support tube 76 is welded to the header flange plate 74, wherein the support tube 76 extends outward to provide support to a vertically disposed upright cylinder support 82.

Turning now to FIG. 6, the cylinder support 82 is fabricated from solid steel for strength, and is welded directly to the support tube 76. At the top of the cylinder support 82 is an upper eye 84, defining a hole (not illustrated) disposed to provide a connection point for the upper portion of hydraulic cylinder 86. Similarly, at the opposing end, its ram 88 is connected to a vertically movable wheel carriage 90 having a wheel retainer 92 bolted thereto. The wheel retainer 92 is U-shaped to rotatingly receive a wheel 94 and its axle (not illustrated). With this arrangement, the ram 88 can be operated to vertically adjust the wheel carriage 90, and wheel 94 to the proper elevation to rest on the top surface 50 of curb 32 to track the curb 32 as the sidewalk grader 20 advances along the road structure 30. Although a preferred embodiment employs a wheel 94 to track the curb 32, any type of rolling device or track-type roller (not illustrated) would be satisfactory. Indeed, even a solid metal plate (not illustrated) could be used in this situation with somewhat less desirable results.

In addition to the above, the wheel carriage 90 includes two spaced-apart upright stabilizer columns 98 and 100, welded to a flange 102 of the wheel carriage 90. In this way, the upright stabilizer columns 98 and 100 can be slidingly received into spaced-apart stabilizer sleeves 104 and 106 which are welded to support tube 76 and welded to the cylinder support 82 for added strength to stabilize the wheel carriage 90 as it is adjusted up and down vertically. To provide a lifting point, a lifting lug 101 is welded to the upper most portion of the cylinder support 82.

As will be discussed more fully in the following, as the sidewalk grader 20 advances along the road structure 30, the wheel 94 should be adjustable between a first lower limit, to raise the sidewalk grader 20, where the sidewalk grader 20 is tracking the top surface 50 of a curb 32 to grade and prepare a sidewalk base 26, to a second upper limit, thereby lowering the sidewalk grader 20 to enable the sidewalk grader 20 to follow the curb 32 as it drops to an area reserved for a driveway (not illustrated), i.e., where the curb transitions downward and fades into the driveway. At this point, the wheel 94 would have to be raised to the upper limit to make up for the loss of the curb 32.

In order to set these limits, a plurality of limit holes 108 are provided through the upper portion of the cylinder support 82 to receive a limit stop pin 110 disposed to stop the upper movement of the wheel, and a spaced-apart limit stop pin 112 disposed to stop the lower movement of the wheel as the same moves over a top surface 50 of a curb 32. For this purpose, a limit lug 114 is provided. One example of a limit lug 114 is a bolt 116 that extends through stabilizer column 100 as illustrated in FIG. 6.

Figure 5:
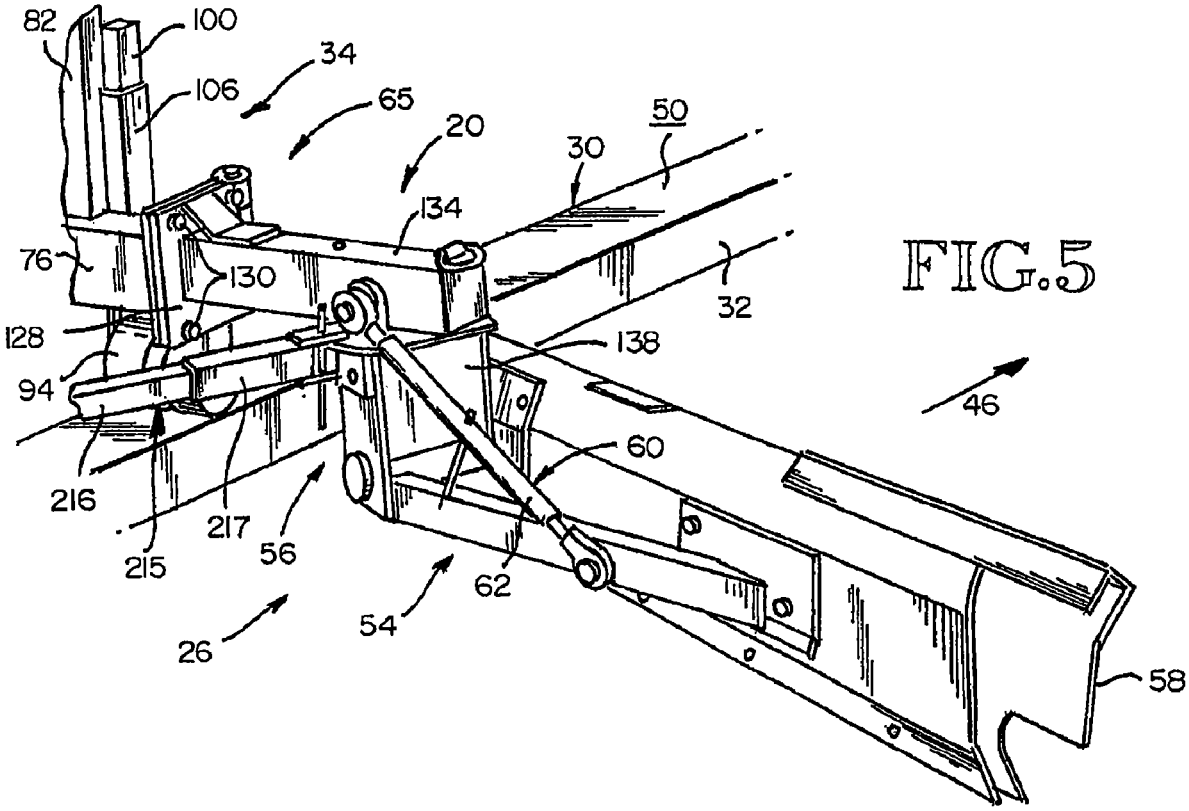
FIG. 5 is a partial rear perspective view of a grading assembly extending from a tracking assembly, of a sidewalk grader, with the tracking means, i.e., tracking roller, disposed for rolling engagement with the top surface of a curb.

Turning now to FIGS. 5 through 7 a grading assembly 54 is illustrated extending from the tracking assembly 34. In one embodiment, the tracking assembly 34 further comprises an additional pivot joint 65 to facilitate the ease of folding the sidewalk grader 20 to the fully folded position as illustrated in FIG. 2C. In the construction thereof, pivot joint 65 is similar to pivot joint 64. Specifically, pivot joint 65 includes a header flange plate 120 that is welded to the end of support tube 76 (see FIG. 6). In this way, stationary hinge sleeve 122 can be welded to the header flange plate 120. This arrangement facilitates a pivotal connection with spaced-apart rotating upper and lower hinge sleeves 124 disposed to receive stationary hinge sleeve 122 therebetween, in axial alignment to allow a pivot pin 126 to be placed through all three aligned sleeves.

Accordingly, spaced-apart rotating upper and lower hinge sleeves 124 are welded to a hinge plate 128 thereby permitting the hinge plate 128 to pivot about a substantially vertical axis. In order to firmly hold the hinge plate 128 in place when the sidewalk grader 20 is in the unfolded position, a plurality of bolts 130 are placed through aligned holes 132 (FIG. 4) provided in the header flange plate 120, and hinge plate 128 when the two plates are butted together as illustrated in FIGS. 5, 6 and 7. Likewise, a frame support tube 134 is welded to the hinge plate 128, and reinforced by plate 136.

Further, the frame support tube 134 extends outward as part of the frame 56 to provide support to the grading blade 58. As can be seen, the above describes an embodiment comprising one type of hinged joint construction. It should be understood, however, that many different configurations and reinforcements could be used with equal effectiveness.

Directing attention to FIG. 5 a rear perspective view of one embodiment of a grading assembly 54 is illustrated. Typically, the structure of grading assembly 54 is a modified tractor rear-blade of the type commonly built for use in a three-point connection set-up configuration that is found on most farm tractors. For example, FIG. 5 shows a rear blade manufactured by FRONTIER, model No. RB1072. As can be seen, the frame support tube 134 was formed by removing the three-point connection portion (not illustrated). Thus, the grader assembly 54 comprises this modified portion. To integrate the grader assembly 54 as a part of the sidewalk grader 20, the frame support tube 134 is welded to hinge plate 128. Accordingly, frame support tube 134 is positioned, i.e., rotated to align for pivotal connection between the hinge plate 128 and the header flange plate 120.

Further, the grader assembly 54 includes a frame housing 138 that, in its pre-modified form, is rotatably mounted to frame support tube 134 for rotation about a substantially vertical axis. However, in the present invention, the frame housing 138 is fixed, i.e., welded to the frame support tube 134 to maintain their relative position as illustrated in FIG. 5.

Figure 9:
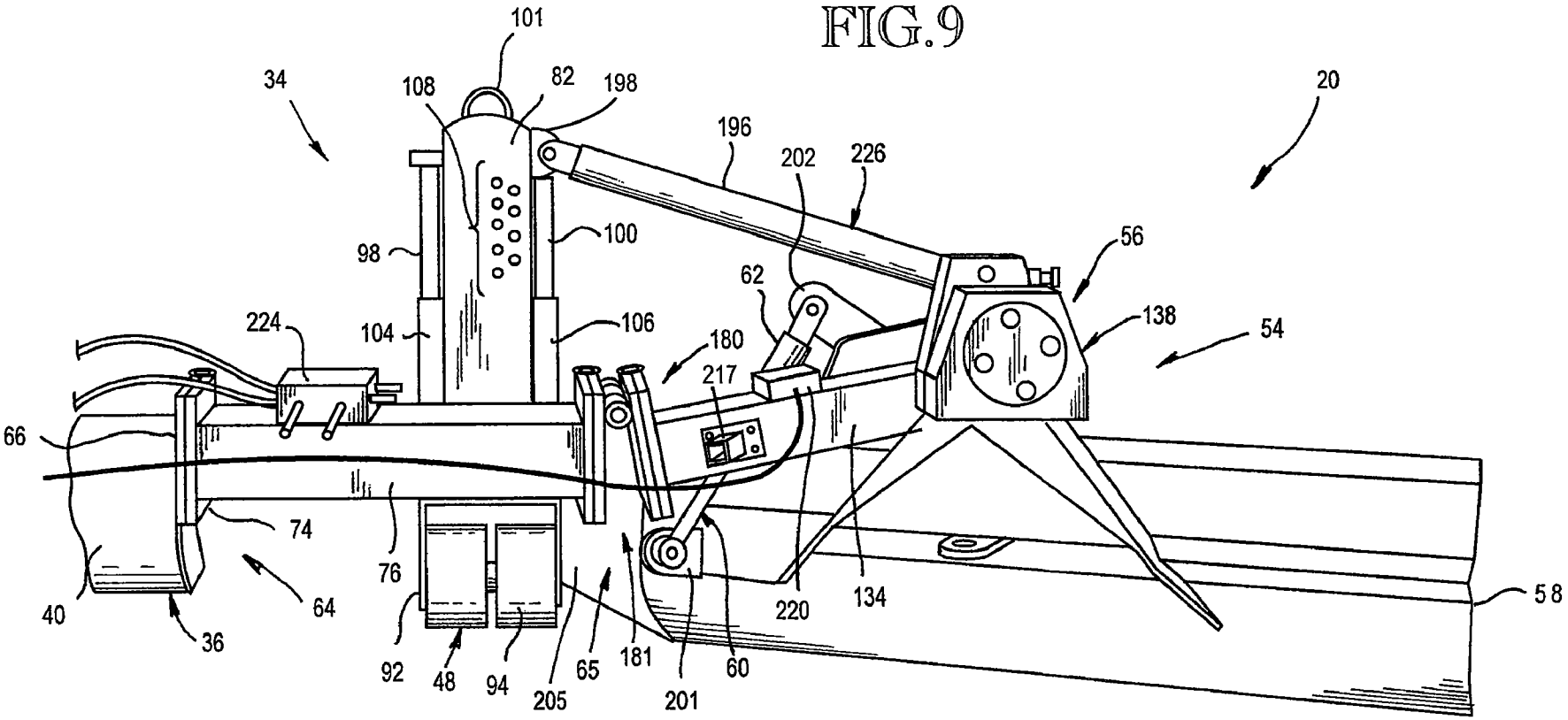
FIG. 9 is a rear elevation view of a sidewalk grader having a dual-axis pivot joint connecting the tracking assembly to the grading assembly, and wherein a hydraulically actuated adjustable slope control link extends from the tracking assembly to the frame of the grading assembly.

Moreover, the typical construction of a farm-type rear blade includes a frame housing 138 configured to receive the journal portion of a shaft (not illustrated) extending from the blade to rotatingly support the grading blade 58. Accordingly, for the present application, an adjustable link 62 is disposed to connect the grading blade 58 to the frame housing 138 of the frame 56. This connection could be made either behind the blade 58 as illustrated in FIG. 5, or in front of the blade as illustrated in FIG. 9.

Because the "length" of adjustable link 62 is variable, the slope of the grading blade 58 can be set to a predetermined slope to produce the specified grade as the sidewalk grader 20 advances along the road structure 30. It should be noted that "turnbuckle" type links, commonly employed as farm tractor top links, are satisfactory for use as adjustable link 62. Similarly, "ratchet" type tractor links, are also commonly substituted and provided as adjustable link 62, as well as hydraulically controlled cylinder type actuators.

As described above the grading assembly 54 comprises the FRONTIER RB1072 farm type rear blade as illustrated in FIGS. 5 and 7. In some applications, however, a slightly larger rear blade would be more suitable for the sidewalk grader 20. One example of such a rear blade is FRONTIER model RB1184 which is illustrated in FIGS. 9, 10 and 16. As can be seen, in most respects, the components thereof correspond to, and are mostly the same. Accordingly, for simplicity, the numerals indicating the various corresponding components are the same.

One difference in arrangement, however is that the adjustable blade link 62 is disposed on the other side of frame support tube 134. To facilitate this placement, eye lug 201 is welded to the grading blade 58 to receive one end of adjustable blade link 62, and eye support 202 is disposed to extend from housing plate 203, to receive the other end of the link, wherein the housing plate 203 is fixed to the frame housing 138.

Another variation in grading blade 58, is the modification thereof to include a directional blade attachment 205. This attachment is provided to attach to the end of the grading blade 58 that is disposed closest to the curb 32. This the use and placement of the directional blade attachment 205 is to improve, and efficiently direct the flow of graded material from the grading blade 58.

Directing attention to FIGS. 10 and 12, a blade stabilizer 144 is illustrated and provided as an option to add stability to the backfill blade 40 of a compact excavator 42. The optional blade stabilizer 144 is fixed to an end of backfill blade 40, opposing the tracking assembly 34. In construction, it is similar to portions of the tracking assembly 34. For example, a bracket plate 146 is either bolted or welded to the backfill blade 40 to receive and maintain cylinder support 148. For this purpose, cylinder support 148 is welded to bracket plate 146. The cylinder support 148 includes a lifting ring 150 above, and an upper eye 152 disposed to receive a hydraulic cylinder 154.

In addition, the ram portion 156 thereof is attached to wheel carriage 158 for vertical movement. Such vertical movement is provided to position a wheel 160 on the road structure 30 to stabilize the backfill blade 40. To facilitate attachment of the wheel 160 to the wheel carriage 158, wheel retainer 162 is provided. Similar to the tracking assembly 34, a stabilizer sleeve 166 is fixed or welded to cylinder support 148. In this way, stabilizer column 164 can be slidingly received into the stabilizer sleeve 166 so that the same acts as a guide for the vertical movement thereof when the hydraulic cylinder is operated in concert with the up and down motion of the backfill blade 40. Also provided are a plurality of limit holes 168 disposed to receive an upper limit pin 170, and a lower limit pin 172. These pins are positions to define a upper and lower range of movement of the wheel carriage 158 and accordingly the wheel 160. For this purpose, a limit lug (FIG. 16) extends horizontally from the stabilizer column 164, between the limit pins 170 and 172.

Turning now to FIGS. 11 and 11A, another embodiment is illustrated where a dual-axis pivot joint 180 is employed to allow an up-down pivotal movement of the grading assembly 54. Similarly, the dual-axis pivot joint 180 is a modification of pivot joint 65. The modification is accomplished by separating and spacing hinge plate 128 from header flange plate 120, followed by the insertion of hinge insert 181. Hinge insert 181 comprises hinge plate 183 having spaced apart hinge sleeves 185 fixed thereto, and hinge plate 187 having stationary hinge sleeve 189 fixed thereto, i.e., welded. The two hinge plates 183 and 187 are hingedly joined by axially aligning stationary hinge sleeve 189 between spaced apart hinge sleeves 185 with a hinge pin 188 disposed to hingedly join them together. As will be discussed more fully in the following, one embodiment of the invention comprises a grading assembly 54 that pivots up-and-down about a substantially horizontal axis defined by pivot pin 188.

To enable hinge insert 181 to pivotally join existing header flange plate 120 to hinge plate 128, stationary sleeve 190 is fixed to hinge plate 183, and spaced-apart hinge sleeves 191 are fixed to hinge plate 187 as illustrated. In this way, alignment of stationary hinge sleeve 122 between hinge sleeves 191, will accommodate pivot pin 126 for the connection. Similarly, alignment of stationary sleeve 190 between upper and lower hinge sleeves 124, will accommodate pivot pin 186 for the connection of hinge plate 128 to hinge plate 183.

In addition, a pattern of holes 193 is provided in each hinge plate 183 and 187 so that hinge plate 187 will bolt up to header flange plate 120, and hinge plate 183 will bolt up to hinge plate 128. With this arrangement, the sidewalk grader 20 can be fixed in the unfolded position yet still permit up and down pivotal movement about pivot pit 188. Depending on the construction of the hinge plates 183 and 187, a spacer plate 194 may be required for precise fit with adjacent plates.

Importantly, this arrangement is provided so that a slope control link 196 can extend from the eye lug 198 provided on cylinder support 82, of tracking assembly 34, to the eye lug 200 of grading assembly 54 to control the slope of the grading blade 58. In a preferred embodiment, the slope link 196 is a hydraulically actuated cylinder that is electronically controlled as will be more fully discussed below. With this configuration, the grading blade 58 can be remotely controlled. However, if a more simplified embodiment of the above noted arrangement is desired, a wedge 192 could be inserted in the dual-axis pivot joint 180 as illustrated in FIG. 11. A wedge 192 so inserted would fix the up-down pivot motion of the dual-axis pivot joint 180, and therefore eliminate the need for a slope control link 196.

Also with this modification of pivot joint 65, an extension assembly 204, as illustrated in FIG. 16, can employed to extend the grading assembly 54 further from the tracking assembly 34 to accommodate a situation where the sidewalk is spaced some distance from the curb 32. As illustrated, an extension assembly 204 comprises an extension shaft 206 that is received into an extension receiver tube 208. The extension shaft 206 comprises a plurality of extension holes 210 disposed for alignment with a stop pin 212 that extends through a stop hole 214 provided through extension receiver tube 208. As illustrated, the ends of the extension assembly 204 are configured to mate-to the existing hinge plates with existing hinge pins: to hinge plate 128 on the end disposed adjacent the grading assembly 54, and to hinge plate 183 of pivot joint 65. Accordingly, the extension assembly 204 can be set to multiple extension lengths.

Figure 1:
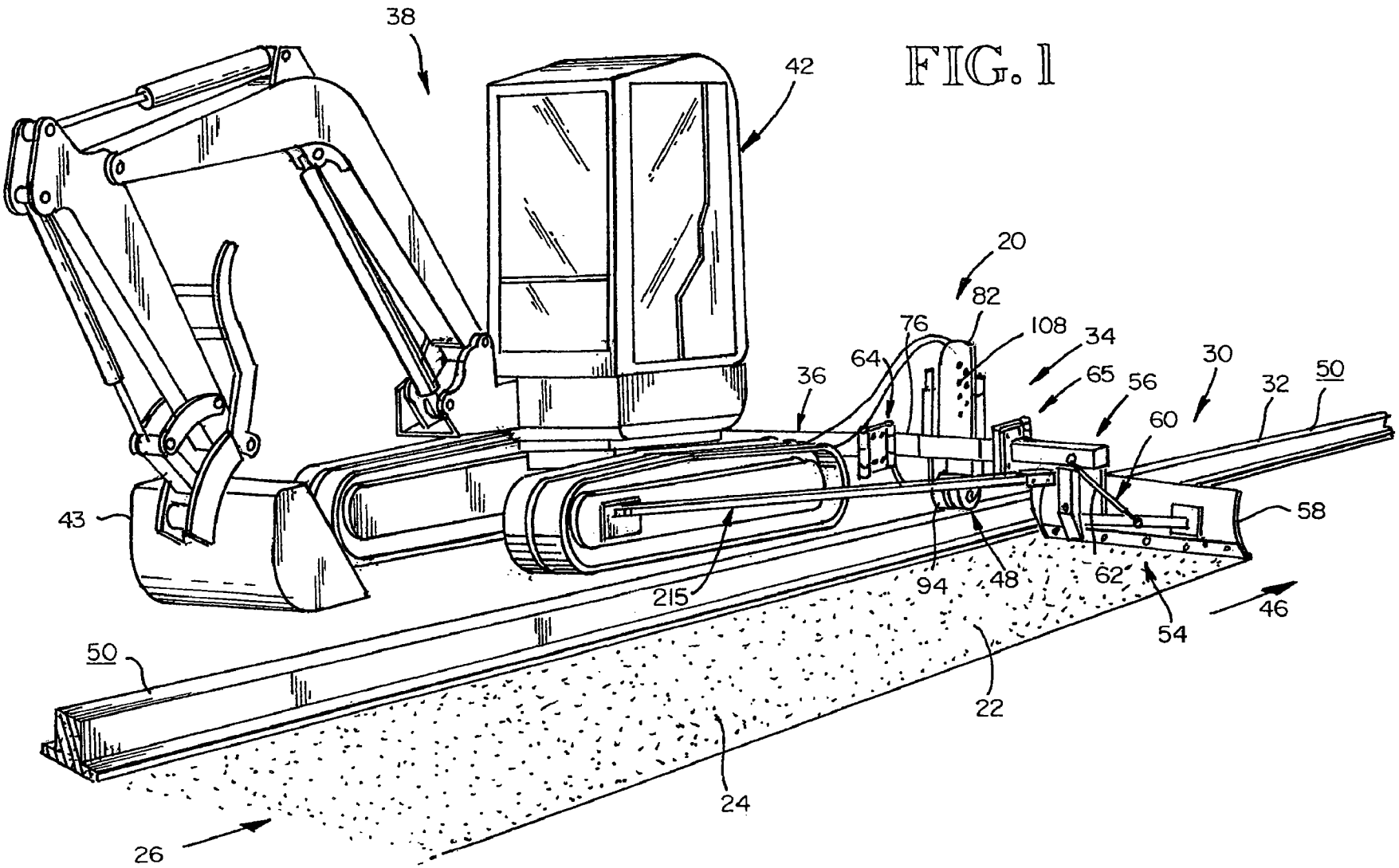
FIG. 1 is a perspective view of a sidewalk grader mounted and fixed to the backfill blade of a compact excavation machine, with the tracking assembly comprising a tracking wheel to engage the top surface of a curb, and with the grading assembly extending from the tracking assembly, over the curb, and where the grading assembly is braced to the excavator structure.

Because the above noted extension can place the grading assembly 54 at a distance from the tracking assembly 34, a brace 215 can be employed to help absorb some of the forces generated from the grading operation. FIGS. 1 and 7 illustrate such a brace 215 that includes a brace extension 216 which is received into brace socket 217 fixed to the grading assembly 54. The brace typically extends from the excavator to the grading assembly 54.

Turning now to FIGS. 9, 13 and 14 a slope control system 218 is illustrated. The primary components of the slope control system 218 are provided by Topcon positioning Systems Inc. located in Pleasanton, Calif. For this equipment, Topcom supplies a "paver" software especially designed for road work. Briefly, the positioning system, i.e., slope control system 218 includes a slope sensor 220 which is located on the frame of the grading assembly 54. The slope sensor 220 is in communication with a proprietary control box 222 provided by Topcon. In the preferred invention, a "System Five 9256 Control Box" is employed. This system is a readily obtainable off-the-shelf system that is easily set-up by technicians employed by a compact excavator dealer. Additionally, because this system includes proprietary information, a discussion of the internal "workings" and circuits is beyond the scope of this specification.

In operation, this slope control system 218 is installed to compensate for any deviation in slope of the grading blade 58 caused by bumps in the road structure 30, change in slope of the road structure, and excavator load changes and the like. Accordingly, the slope sensor 220 senses any change in slope and communicates the change to the control box 222 which then signals an electronically controlled valve stack 224 to activate the slope control link 196, i.e. slope control link hydraulic cylinder 226, to compensate for the change. In this way, the grading blade 58 is automatically controlled to provide a smoothly graded base 26 for the sidewalk.

The electronic controlled valve stack 224 controls hydraulic fluid supplied thereto, and is supplied by Sauer Danfoss. Specifically, the preferred embodiment includes an electrically actuated and controlled valve stack 224 that includes a PVG 32-Variable controller for electronically controlling the hydraulic valve stack 224 dedicated to the slope control link 196, i.e., slope control hydraulic cylinder 226. Accordingly, this type of electronic control is well suited for interface with the slope control system 218 as noted above.

Additionally, in the present invention, the electronically controlled valve stack 224 includes at least two other electronically controlled valves: one to control the backfill blade 40 of the compact excavator 42, and another valve to control the hydraulic circuit that includes the adjustable blade link hydraulic cylinder 62, the tracking assembly hydraulic cylinder 86 and the backfill blade stabilizer hydraulic cylinder 154. This arrangement is the result of reconfiguring the hydraulic hoses that operate the backfill blade 40 on a stock compact excavator 42.

Specifically, the two hydraulic hoses that operate the stock backfill blade 40 are rerouted to the electronically controlled valve stack 224 for supplying the same as noted above. Accordingly, the backfill blade 40 is now connected to, and controlled by the aftermarket valve stack. In this way, the operator can electronically control the valve stack from within the cab of the excavator to control all hydraulic circuits that affect the sidewalk grader.

This arrangement results in the hydraulic hose routing illustrated in FIG. 14, i.e., two hydraulic hoses from the excavator are routed to the valve stack, and six hydraulic hoses (three pairs of two hoses each) are routed to the various hydraulic components as noted above.

Moreover, because the electronically controlled valve stack 224 is electronically controlled, the supplier of the excavator can arrange the "thumb control" in the cab, with electrically operated button controls. For example, one pair of buttons could control the up and down motion of the backfill blade 40. Similarly, one pair of buttons could control, simultaneously the up and down motion of the backfill blade stabilizer, the tracking assembly 34, and the grading blade slope. This arrangement would be particularly useful when each of the same are restrained between limits set according to whether the sidewalk grader is grading along a constant elevation curb top surface, or whether the sidewalk grader is grading at the intersection of a driveway where the elevation and grade setting have to change to accommodate the driveway.

Finally it should be noted that in an embodiment of the invention, the frame housing 138 comprises a slope limit assembly 232 to limit the range that a grading blade 58 can travel. For that purpose, the slope limit assembly 232 includes a limit base 237 adapted to threadedly receive a left stop 234 defined as a bolt 238 with an adjusting nut 240, and a right stop 236 defined by a like bolt 242 with an adjusting nut 244. In operation, a limit lug 246 attached to the rotating portion of the grading blade 58 is disposed between the left and right stops 234, 236 which thereby define the range that the grading blade 58 can travel to a predetermined slope to produce a specified grade of the sidewalk base 26.

Having illustrated and described the principles of my invention in a preferred embodiment thereof, it should be readily apparent to those skilled in the art that the invention can be modified in arrangement and detail without departing from such principles. I claim all modifications coming within the spirit and scope of the accompanying claims.

What is claimed is:

1. A sidewalk grader for grading the area reserved for a sidewalk to a predetermined specified grade and elevation to form the base of a designed sidewalk that extends adjacent to and along an existing road structure of the type having a curb as a border, the sidewalk grader comprising:

a tracking assembly adapted for fixable engagement with a vertically movable accessory extending from a piece of construction excavation equipment disposed to move forward over an existing road structure to advance the sidewalk grader in a direction along the existing road structure, substantially parallel thereto, the tracking assembly being configured to extend from the vertically movable accessory in a transverse direction to the course of advancement, transversely across the road structure and the curb thereof;

the tracking assembly further comprising a tracking member disposed for engagement with a top surface of a curb portion of the road structure and use of the top surface as a point of reference for operation of the sidewalk grader;

a grading assembly mounted to the tracking assembly, extending outward therefrom, to extend beyond the curb portion of a road structure, over the location of an area reserved for a designed sidewalk, the grading assembly comprising:

a frame, and a grading blade mounted to the frame with a slope of the grading blade set according to the specified sidewalk design grade; and wherein the tracking member is engageable with the top surface of the curb portion to provide a point of reference for precise vertical and horizontal positioning of the grading blade to maintain the grading assembly in the desired position in relation to the curb as the sidewalk grader advances along the existing road structure.

2. A sidewalk grader as recited in claim 1, wherein the tracking assembly is adapted for fixable engagement with a backfill blade of a compact excavator.

3. A sidewalk grader for grading the area reserved for a sidewalk to a predetermined specified grade and elevation to form the base of a designed sidewalk that extends adjacent to and along an existing road structure of the type having a curb as a border using a piece of construction excavation equipment positioned on the road structure, the sidewalk grader comprising:

a tracking assembly attachable to a vertically movable accessory extending from the piece of construction excavation equipment disposed to move forward over the existing road structure to advance the sidewalk grader in a direction along the existing road structure, substantially parallel thereto, the tracking assembly being configured to extend laterally from the vertically movable accessory toward the curb, across the road structure and the curb thereof, the tracking assembly including a tracking member disposed for engagement with a top surface of the curb of the road structure and use of the top surface as a point of reference for operation of the sidewalk grader; and a grading assembly mounted to the tracking assembly and extending laterally outward therefrom and beyond the curb, the grading assembly including a grading blade positionable at the area reserved for the designed sidewalk with a slope according to the specified sidewalk design grade, wherein the tracking member is engageable with a top surface of the curb to provide a point of reference for precise vertical and horizontal positioning of the grading blade to maintain the grading assembly in the desired position in relation to the curb as the sidewalk grader advances along the existing road structure.

4. A sidewalk grader as recited in claim 3, wherein the grading assembly includes a frame and the grading blade is mounted to the frame with the slope set according to the specified sidewalk design grade.

5. A sidewalk grader as recited in claim 3 for use with the vertically movable accessory extending from the piece of construction excavation equipment being a backfill blade of a compact excavator, wherein the tracking assembly is adapted for fixable engagement with the backfill blade of the compact excavator.

6. A sidewalk grader for grading an area reserved for a sidewalk to a predetermined specified grade and elevation to form the base of a designed sidewalk that extends adjacent to and along an existing road structure of the type having a curb as a border, the sidewalk grader comprising:

a tracking assembly adapted for attachment to a vertically movable backfill blade extending from a compact excavator disposed to move forward over an existing road structure to advance the sidewalk grader in a direction along the road structure, substantially parallel thereto, the tracking assembly being configured to extend laterally from the backfill blade toward the curb;

the tracking assembly further comprising a tracking member disposed for engagement with a top surface of the curb of the road structure and use of the top surface as a point of reference for operation of the sidewalk grader, the tracking member engagable with the top surface of the curb for vertical and horizontal positioning of a grading assembly to maintain the grading assembly in a selected position in relation to the curb as the sidewalk grader advances along the existing road structure; and wherein the grading assembly is mounted to the tracking assembly and extends laterally outward therefrom and beyond the curb when in use to the location of the area reserved for the designed sidewalk, the grading assembly including a grading blade positionable at the area reserved for a sidewalk and having a slope set according to the specified sidewalk design grade with the compact excavator on the existing road structure.

7. A sidewalk grader for grading the area reserved for a sidewalk to a predetermined specified grade and elevation to form the base of a designed sidewalk that extends adjacent to and along an existing road structure of the type having a curb as a border using, the sidewalk grader comprising:

a vehicle positionable on the road structure and having a vertically movable accessory extending therefrom, the vehicle being movable forward over the road structure to advance the sidewalk grader in a direction along the road structure, substantially parallel thereto;

a tracking assembly attachable to the vertically movable accessory of the vehicle, the tracking assembly being configured to extend from the vertically movable accessory in a lateral direction and toward the curb, across the road structure and the curb thereof, the tracking assembly including a tracking member disposed for engagement with a top surface of the curb of the road structure and use of the top surface as a point of reference for operation of the sidewalk grader; and a grading assembly mounted to the tracking assembly and extending outward therefrom and beyond the curb, the grading assembly including a grading blade positionable at the area reserved for the designed sidewalk with a slope according to the specified sidewalk design grade, whereby the tracking member is engageable with the top surface of the curb to provide a point of reference for positioning of the grading blade to maintain the grading assembly in the desired position in relation to the curb as the sidewalk grader advances along the road structure.

* * * * *

UNITED STATES PATENT AND TRADEMARK OFFICE

CERTIFICATE OF CORRECTION

PATENT NO. : 7,624,520 B2
APPLICATION NO. : 11/533696
DATED : December 1, 2009
INVENTOR(S) : Ronald H. Gordon It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 478 days.

Signed and Sealed this

Twenty-sixth Day of October, 2010

David J. Kappos

David J. Kappos
*Director of the United States Patent and Trademark Office*